United States Patent [19]

Duel et al.

[11] 3,992,737

[45] Nov. 23, 1976

[54] SUSPENSION SYSTEM FOR UNDERWATER EQUIPMENT

[75] Inventors: Don Myrton Duel, Phoenix, Ariz.; Helmut Carl Maiershofer, Valencia, Calif.

[73] Assignee: Motorola, Inc., Chicago, Ill.

[22] Filed: Dec. 11, 1975

[21] Appl. No.: 639,738

[52] U.S. Cl. ..... 9/8 R; 340/2

[51] Int. Cl.[2] ..... B63B 21/52

[58] Field of Search ..... 9/8 R; 116/124 B, 114 AH; 340/2, 8 S, 8 R

[56] References Cited

UNITED STATES PATENTS

| | | | |
|---|---|---|---|
| 3,631,550 | 1/1972 | Bullen | 9/8 R |
| 3,701,175 | 10/1972 | Widenhofer | 9/8 R |
| 3,720,909 | 3/1973 | Sikora | 340/2 |
| 3,800,271 | 3/1974 | Stillman, Jr. | 9/8 R |
| 3,921,120 | 11/1975 | Widenhofer | 116/124 B |

FOREIGN PATENTS OR APPLICATIONS

| | | | |
|---|---|---|---|
| 690,288 | 4/1965 | Italy | 9/8 R |

*Primary Examiner*—George E. A. Halvosa
*Assistant Examiner*—Jesus D. Sotelo
*Attorney, Agent, or Firm*—M. David Shapiro; Harry M. Weiss

[57] ABSTRACT

A system for suspending underwater equipment at a predetermined depth below the surface; the system providing storage means for the equipment prior to deployment, protection for the equipment during deployment and stabilization of the equipment at a predetermined depth below the water surface after deployment. A subsystem of virtual masses and a vertically oriented "window shade" drogue is deployed to provide stabilization of the equipment in both vertical and horizontal directions after deployment. Portions of the deployment package are subsequently utilized as part of the stabilization subsystem.

19 Claims, 4 Drawing Figures

SUSPENSION SYSTEM FOR UNDERWATER EQUIPMENT

FIELD OF THE INVENTION

The invention relates to a simplified system for suspension of an equipment package in an underwater environment after dispensing of the system from above the water surface.

BACKGROUND OF THE INVENTION

In prior art systems for deploying undersea equipment from an aircraft, a tubular package configuration has been utilized to protect the equipment during deployment. Upon striking the water, means are employed to withdraw the equipment from the tubular package and the tube is then utilized as the system flotation means or as a weight on the lower extremity of the system in the case of deep deployment of the equipment package. These prior art systems suffer from complexity and, hence, high cost and the vertical orientation of the virtual mass is not particularly efficient in stabilizing the equipment suspended below. Typically, where an underwater drogue is deployed for horizontal stabilization purposes, a complex mechanical drogue erecting system is used to deploy the drogue adding still more to the cost of the system and tending to reduce the reliability thereof.

SUMMARY OF THE INVENTION

The shortcomings and problems of prior art systems are overcome in accordance with the present invention, by utilizing a tubular containing package which is split in half longitudinally. The two halves of the containing tube are then utilized along the top and bottom edges of a "window shade" shaped drogue for stiffening each of these horizontal edges in the underwater environment. Each tubular half section open portion is covered by a loose fitting flexible material which in turn is connected to the flexible material vertical sheet or sail which is put in tension between the two horizontally oriented tubular half sections, and provides horizontal stabilization for the underwater system.

According to one aspect of the invention, the virtual mass created by the drag created by water forced to flow around the sections and by the water trapped by the tubular half sections and the attached flexible covering provides improved vertical stability of the suspended equipment package.

According to another aspect of the invention, the vertical sheet or drogue provides horizontal stability of the suspended equipment package with respect to the water at drogue depth.

According to still another aspect of the invention, the longitudinally split tubular package provides a lower cost approach to the protection and stabilization of the equipment package and to the vertical sail deployment.

These and other aspects of the invention will be understood more fully from the following detailed description of the invention and the drawings in which.

DETAILED DESCRIPTION OF THE INVENTION

Figure 4:
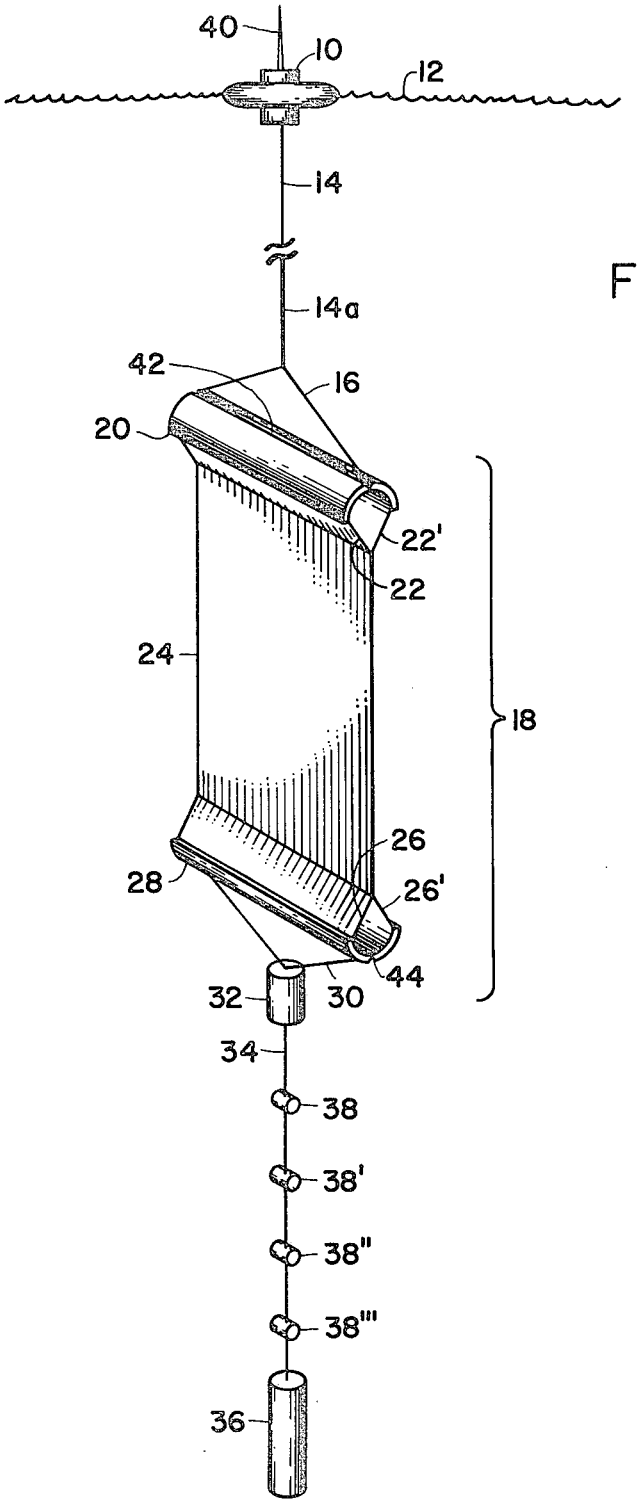
FIG. 4 shows the system of FIG. 1 completely deployed in the underwater environment.

The details of the invention may best be understood by first referring to FIG. 4. There shown is inflatable buoyant flotation device 10 floating on the surface of water 12. Flotation 10 provides a means of vertical support and reference positioning for the balance of the system. Flotation device 10 is connected through cable 14 and bridle 16 to the stabilizing elements 18 of the invention. Some portion of cable 14 may be made of elastic to permit float 10 to move vertically in response to wave action of water surface 12 without translating this vertical motion to stabilizing elements 18. Bridle 16 is connected at the extremities to upper longitudinally sectioned member 20 of a hollow tube 20 and 28. Upper tube half section 20 has a concave side which is covered by loosely fitting flexible enclosure means 22, 22′. Enclosure means 22, 22′ may be a single piece of flexible material. Enclosure means 22 is continuously fastened along one of the open edges of upper half section 20 while enclosure means 22′ is continuously connected along the other of the open edges of upper half section 20. At the junction of enclosures 22, 22′, preferably at an equal distance from each of the edges of upper half section 20, one edge of horizontal stabilizing means 24 is connected continuously as shown. Horizontal stabilizing means 24 may be of any suitable flexible sheet material. The lower edge of flexible sheet material 24 is connected continuously to the junction of enclosure means 26, 26′. The enclosure means 26, 26′ is similar in nature to enclosure means 22, 22′. Enclosure means 26 is continuously fastened to one edge of lower half section 28 of tube 20, 28. Enclosure means 26′ is continuously fastened to the other edge of lower half section 28 of tube 20, 28. Lower half section 28 is connected to equipment package 32 by bridle 30 similar to the way in which upper half section 20 is connected by bridle 16 to cable 14. Alternately, a short length of cable may connect bridle 30 to equipment package 32 (not illustrated). Cable 34 connects equipment package 32 to weight 36. Some portion of cable 34 preferably is elastic to prevent communication of motion or acoustic noise from equipment package 32 and/or drogue assembly 18 to equipments 38. Alternatively an elastic element may be incorporated in cable 30 to prevent communication of motion or acoustic noise from stabilizing elements 18 to equipment package 32. Auxiliary portions 38 of equipment package 32 may also be supported by cable 34.

Bridles 16 and 30 cause virtual mass assemblies 20, 22 and 26, 28 to be disposed with their largest dimensions normal to cables 14 and 34, and, therefore, normal to the vertical motion of cables 14 and 34. This orientation of virtual mass is the most efficient for effectively preventing motion in the direction of the longer dimension of cables 14 and 30.

The system of the invention as shown deployed in FIG. 4 operates as follows: inflatable flotation device 10 is used to support the entire system in the water. Horizontal stabilizer flexible sheet means 24 is utilized to maintain the horizontal position of the entire system constant with respect to the surrounding water. It has been shown for example in, "Improved Drifting Buoy Performance by Scale Model Drogue Testing", by W. A. Vachon in *Marine Technology Society Journal*, Volume 8, Number 8, January, 1974, at page 61, that this "window shade" type drogue system, ". . . will stream normal to the flow if the drogue is symmetric and the tether point is attached in line with the center of the drogue". Window shade drogue 24 then operates to maintain the position of the system of the invention in a stabilized position with respect to the horizontal motion of the surrounding water.

The enclosure formed by upper half section 20 and enclosure means 22, 22' acts to contain a volume of water therein. The end sections of enclosure 20, 22, 22' may or may not be enclosed. An aspect of the configuration is the fact that the trapped water is restricted from motion in the vertical direction, whether or not end enclosures are employed. The entrapped water within the enclosure and the water forced to flow in a longer path around the enclosure act as a virtual mass term in a system for damping the upward and downward motion of the suspended equipment packages 32,38. Similarly enclosure 26, 26' and lower half tube section 28 enclose a like body of water. Here again, the effect of the entrapped and detoured flow of water is to provide a virtual mass for resistance of motion in the vertical direction.

In the typical embodiment of the invention shown in FIG. 4, equipment package 32 is an electronic package, auxiliary equipments 38, 38', etc., are hydrophones and weight 36 is a battery for supplying electrical energy to the sub-system of the equipment package. Cable 34 comprises electrical wiring for interconnecting of equipment package 32, hydrophones 38 and battery 36. An electrical signal cable (not separately shown) connects equipment package 32 to antenna 40 or to electrical equipment (not shown) located in buoyant device 10. This cable is routed along bridle 30 to lower half section 28 thence up one vertical edge of window shade drogue 24 to upper half section 20, along bridle 16 and cable 14 through or around buoyant device 10 to antenna 40 or to electrical equipment (not shown) in buoyant device 10. The electrical cable may serve the mechanical purposes of the inelastic portions of cable 14. In the instant embodiment of the invention hydrophones 38 would be utilized to pick up or sense sound in the underwater environment and to transmit this sound to electronic package 32. Electronic package 32 serves to convert the signal to a form which may be transmitted through the aforementioned electrical cable (not shown) to antenna 40 or to electrical equipment at the upper end of the system. The antenna may then transmit signals to a remote receiver (not shown). It will be understood, however, that the invention is not limited to this particular kind of use. It will be appreciated that the suspension system as described may be used for deployment of any underwater equipment, requiring both horizontal and vertical positioning stability with respect to the underwater environment.

Figure 1:
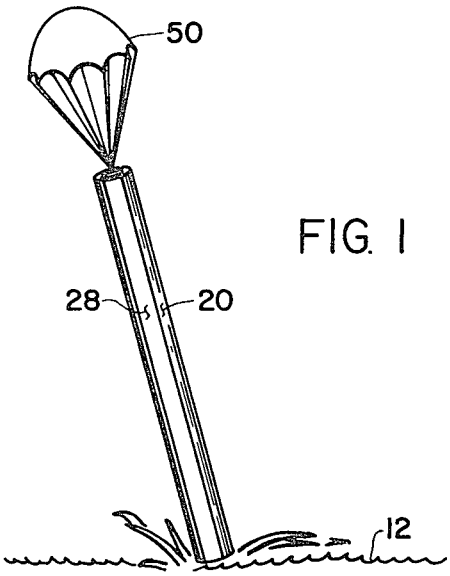
FIG. 1 depicts an embodiment of the system of the invention at the moment of impact with the water surface.
Figure 2:
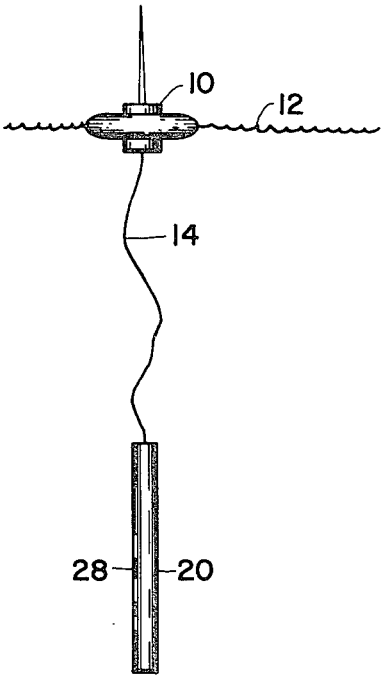
FIG. 2 shows the system of FIG. 1 after deployment of an inflatable flotation device and during payout of a first or upper suspension system.
Figure 3:
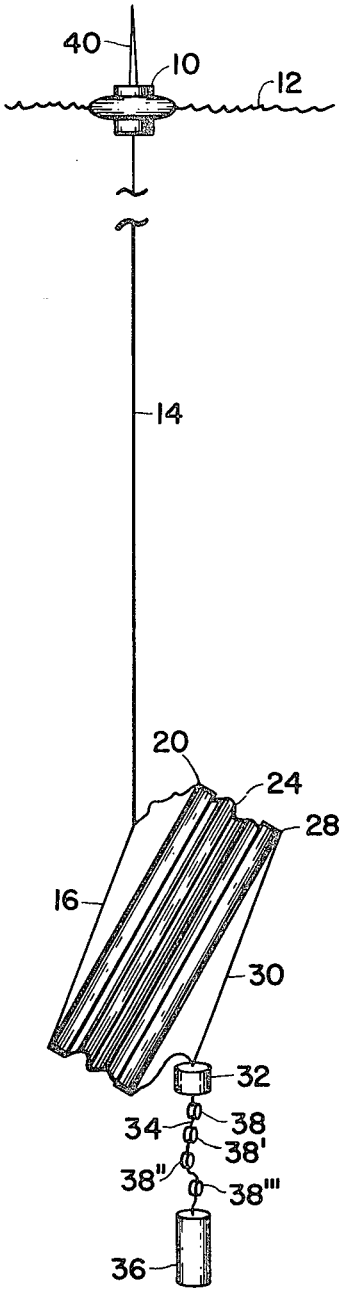
FIG. 3 illustrates the system of FIG. 1 with the first or upper suspension system completely deployed and during the deployment of a vertical sail drogue means.

To better understand the means for deployment of the system the reader is directed first to FIG. 1. The system as there depicted may be dropped, for example, from an aircraft flying above the surface of the water. Parachute 50 is deployed upon release of the system from the carrying vehicle to guide and slow the system fall rate in a vertically oriented attitude until it strikes the water surface 12. As will be seen later, the center of gravity of the enclosed system is kept low to help promote vertical orientation of the long dimension of the system at the time of water impact. Upon impact, parachute 50 is jettisoned. As shown in FIG. 2, buoyant device 10 is deployed and inflated. Cable 14 which may be on the order of 1200 feet long is dispensed from within the hollow tube made up of tube half sections 20 and 28. It will be understood that the remainder of the items of FIG. 4 are still contained within tube 20, 28. Specifically, weight 36 will be contained within the lower end of the tube to provide vertical stability for the system both in the air above the water and as disposed within the water as a result of the low center of gravity, thereby created. Cable 14 continues to be paid out of tube 20, 28 until it reaches its extreme extended condition. This is shown in FIG. 3 wherein fully extended cable 14 has triggered an internal release mechanism (not shown) in tube 20, 28 to fully deploy the remainder of the system. In one embodiment of the invention bridles 16 and 30 are stored in external grooves 42, 44 of upper and lower half tube sections 20 and 28, rspectively, as shown in FIG. 4. In an alternate embodiment of the invention the bridles are stored completely within two tube half sections 20 and 28 and are deployed by the extension of flexible enclosures 22, 22' and 26, 26'. In this case, grooves 42 and 44 are not needed. In either event the bridles are deployed from the tube as the tube is divided into its two half sections 20 and 28. Equipment package 32, auxiliary equipment 38 and weight 36 are also deployed at this time. The combination of the upward buoyant force from the buoyant affect of inflated flotation device 10 and the downward gravitational force from weight 36 and equipment package 32 act to fully extend the system as shown in FIG. 4.

Various other modifications and changes may be made to the present invention from the principles of the invention described above without departing from the spirit and scope thereof as encompassed in the accompanying claims.

What is claimed is:

1. A system for deploying and suspending an equipment package in an underwater environment, comprising in combination:

means for buoyant support of the system;

means for tubularly enclosing the system for protection during deployment into the underwater environment and adaptable for positional stabilization of the system in the water, said tubular means having a diameter, said means for tubularly enclosing the system further comprising:

at least two longitudinally sectioned members of a hollow tube, each of said at least two longitudinally sectioned members having an open concave side along a long dimension of said sectioned member and said open side having two edges; and means for enclosing each of said open sides for restricting a flow of water therein to the direction of said longitudinal dimension, said means for enclosing therefore creating a virtual water mass by means of said enclosures;

first means for suspending the equipment package from said tubular means; and second means for suspending said tubular means from said buoyant support means.

2. The system according to claim 1 wherein said enclosing means comprises:

flexible sheet means having a rectangular shape, said flexible sheet means having longer dimensioned edges equal to said long dimension of said sectioned member and a short dimension at least equal to the diameter of said hollow tube, said sheet means being continuously attached along each of said long dimensioned edges to each of said edges of said open side of said sectioned member, respectively.

3. The system according to claim 2 wherein said flexible sheet means has a shorter dimension approximately equal to an inner perimeter of a cross-section of said sectioned member, said dimension allowing said sheet means to lie smoothly in contact with an inner surface of said sectioned member during deployment of the system, before an opening thereof.

4. The system according to claim 2 wherein said suspension means further comprises:

droque means for stabilization of the the system in a horizontal direction.

5. The system according to claim 4 wherein each of said flexible sheet means has a longitudinal center line and said drogue means further comprises:

a rectangular flexible sheet having at least two parallel edge dimensions approximately equal to said long dimension of said sectioned member, one of said parallel edges being continuously attached to said center line of one of said longitudinal center lines of said enclosing means of said sectioned members and the other of said parallel edges of said rectangular sheet being continuously attached to the other of said center lines of said other of said enclosing means of said sectioned members.

6. The system according to claim 1 wherein said first means further comprises:

means for connecting said buoyant support means to one of said at least two longitudinally sectioned members.

7. The system according to claim 6 wherein said connecting means further comprises:

bridle means for bridging said one of said at least two longitudinally sectioned members.

8. The system according to claim 7 wherein said bridle means is made of flexible rope, said rope being stored within said tubular enclosure during deployment into the underwater environment.

9. The system according to claim 8 wherein said rope is at least partly metallic.

10. The system according to claim 6 wherein said connecting means comprises an elastic portion for isolating and stabilizing the equipment package from said buoyant means.

11. The system according to claim 7 wherein said bridle means is made of flexible rope, one portion of said rope being stored within said tubular enclosure for deployment into the underwater environment and a remaining other portion of said rope being stored along an outside surface of said tubular enclosure for deployment into the underwater environment.

12. The system according to claim 11 wherein said rope is at least partly metallic.

13. The system according to claim 1 wherein said first and second means for suspending comprise elastic means for isolating and further stabilizing the equipment package from said buoyant means.

14. The system according to claim 1 wherein the equipment package comprises a main package and a series of auxiliary packages and wherein said suspending means further comprises a flexible but inelastic means for interconnecting the series of auxiliary packages each to the other.

15. The system according to claim 1 wherein the equipment package comprises:

a main package; and at least one auxiliary package, said suspending means comprising an elastic portion between said main package and said at least one auxiliary package for stabilizing and isolating said at least one auxiliary package.

16. A method for deploying and stabilizing an equipment package into an underwater environment, utilizing a deployment system comprising buoyant support means for suspending the equipment package from the surface of the water, comprising the steps of:

enclosing the deployment system and the equipment package in a tubular enclosure comprising at least two longitudinally section members, said members each having a concave side, said members comprising a first portion of the deployment system;

launching the enclosed deployment system into the underwater environment from above the water;

sensing an impact of the enclosed deployment system with the water to initiate deployment of the buoyant means upon entry into the water;

deployment a first suspension means from the enclosed deployment system said first suspension means connecting the buoyant means to the enclosed deployment system;

extending said first suspension means by means of the buoyant means upward force and the gravitational force on the enclosed deployment system, said forces acting in concert to place said suspension means under a tensile force; and separating said longitudinally sectioned members of said tubular enclosure responsive to said tensile force on said first suspension means, said separation causing deployment of a second portion of the deployment system said second portion of the deployment system comprising:

horizontal stabilization means;

vertical stabilization means;

second suspension means; and the equipment package.

17. The method according to claim 16 wherein said horizontal stabilization means comprises:

vertical sheet means having an upper and a lower edge, said vertical sheet means being supported between a first and a second of said separated longitudinally sectioned members of said tubular enclosure, said first of said sectioned members being continuously attached along said upper edge of said vertical sheet means and said second of said sectioned members being continuously attached along said lower edge of said vertical sheet means for support of both of said edges of said vertical sheet means.

18. The method according to claim 17 wherein said vertical stabilization means comprises:

flexible enclosing means, said enclosing means being disposed across said concave sides of said sectioned members for enclosing a quantity of water therebetween, and for restricting flow of said quantity of water in a vertical direction.

19. The method according to claim 17 wherein said second suspension means comprises:

means for suspending the equipment package from said second sectioned member.

* * * * *